US009404069B1

(12) United States Patent
Kane et al.

(10) Patent No.: US 9,404,069 B1
(45) Date of Patent: Aug. 2, 2016

(54) SYSTEMS AND METHODS FOR COOLING TOWER FILL CLEANING WITH A CHEMICAL GEL

(71) Applicant: Crossford International, LLC, Stamford, CT (US)

(72) Inventors: Timothy J. Kane, Stamford, CT (US); Joseph J. Franzino, Stamford, CT (US); Pete Gentile, Stamford, CT (US); Mark Rothenhausen, Stamford, CT (US); Ray Field, Stamford, CT (US)

(73) Assignee: Crossford International, LLC, Stamford, CT (US)

( * ) Notice: Subject to any disclaimer, the term of this patent is extended or adjusted under 35 U.S.C. 154(b) by 0 days.

(21) Appl. No.: 14/870,230

(22) Filed: Sep. 30, 2015

Related U.S. Application Data

(63) Continuation-in-part of application No. 14/737,995, filed on Jun. 12, 2015.

(51) Int. Cl.

| | |
|---|---|
| ***C11D 3/00*** | (2006.01) |
| ***C11D 3/20*** | (2006.01) |
| ***C11D 3/22*** | (2006.01) |
| ***F28G 9/00*** | (2006.01) |
| ***B08B 9/032*** | (2006.01) |

(52) U.S. Cl.
CPC ..... *C11D 3/0073* (2013.01); *B08B 9/032* (2013.01); *C11D 3/2065* (2013.01); *C11D 3/222* (2013.01); *F28G 9/00* (2013.01)

(58) Field of Classification Search
CPC ..... C11D 3/222; C11D 7/08; C11D 3/43
See application file for complete search history.

(56) References Cited

U.S. PATENT DOCUMENTS

| | | | | |
|---|---|---|---|---|
| 820,371 | A | | 5/1906 | Skinner et al. |
| 1,657,013 | A | | 1/1928 | Kettle |
| 2,223,012 | A | | 11/1940 | Konwinski et al. |
| 2,487,348 | A | | 8/1944 | Malsbary et al. |
| 3,606,091 | A | | 9/1971 | Grisham |
| 4,278,132 | A | | 7/1981 | Hostetter |
| 4,286,636 | A | | 9/1981 | Credle |
| 4,650,699 | A | * | 3/1987 | Mosser ..... C23C 22/74 148/255 |
| 4,675,120 | A | | 6/1987 | Martucci |
| 4,965,009 | A | | 10/1990 | Baur et al. |
| 5,389,284 | A | | 2/1995 | Van Der Hoeven et al. |
| 5,728,660 | A | | 3/1998 | Borah |
| 5,872,111 | A | | 2/1999 | Au et al. |

(Continued)

FOREIGN PATENT DOCUMENTS

| | | |
|---|---|---|
| DE | 3910042 | 10/1990 |
| DE | 102005028295 | 11/2006 |

(Continued)

OTHER PUBLICATIONS

"Samurai 100 Carpet Extractor with Wand and Hoses" Jon-Don (http://www.jondon.com/priority-manufacturing-samurai-100-carpet-extractor.html) download date Oct. 14, 2015; 3 pps.

(Continued)

*Primary Examiner* — Gregory Webb
(74) *Attorney, Agent, or Firm* — Carson C. K. Fincham; Fincham Downs

(57) ABSTRACT

Systems and methods for formulating and utilizing chemical gel formulations, particularly with respect to cooling tower fill cleaning operations.

14 Claims, 2 Drawing Sheets

(56) References Cited

U.S. PATENT DOCUMENTS

| | | | | |
|---|---|---|---|---|
| 5,895,763 | A | 4/1999 | Edstrand et al. | |
| 6,345,640 | B1 | 2/2002 | Newberg | |
| 6,402,891 | B1 | 6/2002 | Asher et al. | |
| 6,569,261 | B1 | 5/2003 | Aubay et al. | |
| 6,705,332 | B2 | 3/2004 | Field et al. | |
| 7,455,246 | B2 | 11/2008 | Roth et al. | |
| 7,500,581 | B2 | 3/2009 | O'Leary et al. | |
| 7,500,584 | B2 | 3/2009 | Schuetz | |
| 7,507,299 | B2 | 3/2009 | Wadsworth et al. | |
| 7,963,463 | B2 | 6/2011 | Breedlove et al. | |
| 8,021,694 | B2 | 9/2011 | Morelli et al. | |
| 8,425,203 | B2 | 4/2013 | Gardner et al. | |
| 8,485,796 | B2 | 7/2013 | Gilpatrick | |
| 8,555,902 | B2 | 10/2013 | Boehm et al. | |
| 8,814,531 | B2 | 8/2014 | Raasch | |
| 2003/0083223 | A1 | 5/2003 | Aubay et al. | |
| 2003/0100469 | A1 | 5/2003 | Connor et al. | |
| 2003/0171244 | A1 | 9/2003 | Schmid et al. | |
| 2003/0230522 | A1 | 12/2003 | Pavel | |
| 2004/0038840 | A1 | 2/2004 | Lee et al. | |
| 2004/0166136 | A1 | 8/2004 | Morelli et al. | |
| 2004/0217183 | A1 | 11/2004 | Bae et al. | |
| 2005/0032668 | A1 | 2/2005 | Pedersen et al. | |
| 2005/0245422 | A1 | 11/2005 | Yamada et al. | |
| 2006/0180795 | A1 | 8/2006 | McCormick | |
| 2007/0010420 | A1 | 1/2007 | Lange et al. | |
| 2007/0018135 | A1 | 1/2007 | McCormick et al. | |
| 2007/0167343 | A1 | 7/2007 | Suzuki et al. | |
| 2008/0050398 | A1 | 2/2008 | Bockmuehl et al. | |
| 2008/0210584 | A1 | 9/2008 | Barthel et al. | |
| 2008/0312118 | A1 | 12/2008 | Futterer et al. | |
| 2010/0056415 | A1 | 3/2010 | Rong et al. | |
| 2010/0294307 | A1 | 11/2010 | Tyborski | |
| 2011/0237484 | A1 | 9/2011 | Griesbach et al. | |
| 2012/0071379 | A1 | 3/2012 | Gonzales et al. | |
| 2012/0207858 | A1* | 8/2012 | Martin | A01N 59/00 424/661 |
| 2012/0291815 | A1 | 11/2012 | Monsrud et al. | |
| 2013/0184192 | A1 | 7/2013 | Vinson et al. | |
| 2013/0214059 | A1 | 8/2013 | Gilpatrick et al. | |
| 2013/0334942 | A1 | 12/2013 | Schestag et al. | |
| 2014/0119949 | A1 | 5/2014 | Wischstadt et al. | |
| 2014/0251390 | A1 | 9/2014 | Khan et al. | |
| 2014/0274973 | A1 | 9/2014 | Pedersen et al. | |
| 2014/0275255 | A1 | 9/2014 | Pedersen et al. | |
| 2015/0020330 | A1 | 1/2015 | Hochkugler et al. | |

FOREIGN PATENT DOCUMENTS

| | | |
|---|---|---|
| DE | 102006009138 | 8/2007 |
| DE | 102009001559 | 12/2009 |
| EA | 000499 | 8/1999 |
| EP | 0887122 | 1/2000 |
| GB | 1327324 | 8/1973 |
| GB | 2461731 | 1/2010 |
| RU | 2436026 | 12/2011 |
| WO | WO9321299 | 10/1993 |
| WO | WO0042149 | 7/2000 |
| WO | WO0066810 | 11/2000 |
| WO | WO2004085596 | 10/2004 |
| WO | WO2005056744 | 6/2005 |
| WO | WO2006128543 | 12/2006 |
| WO | WO2009141742 | 11/2009 |
| WO | WO2010130541 | 11/2010 |
| WO | WO2011047988 | 4/2011 |
| WO | WO2013110682 | 8/2013 |
| WO | WO2014095541 | 6/2014 |
| WO | WO2014139984 | 9/2014 |
| WO | WO2015001294 | 1/2015 |

OTHER PUBLICATIONS

"CoilPro Self Contained Coil Cleaning System" Goodway (http://www.goodway.com/products/coil-cleaning-systems-chemicals/coil-cleaning-machines/coilpro-self-contained-coil-cleaning-system#custom-quicktabs-tab-product_tabs-qt_features) download date Oct. 14, 2015; 2 pps.

International Search Report for PCT/US2015/053088 dated May 12, 2016, 4 pps.

Written Opinion for PCT/US2015/053088 dated May 12, 2016, 5 pps.

* cited by examiner

SYSTEMS AND METHODS FOR COOLING TOWER FILL CLEANING WITH A CHEMICAL GEL

CROSS-REFERENCE TO RELATED APPLICATIONS

The present application is a Continuation-in-Part (CiP) of, and claims benefit and priority to, U.S. patent application Ser. No. 14/737,995 filed on Jun. 12, 2015 and titled "PORTABLE COOLING TOWER CLEANING SYSTEM", the entirety of which is hereby incorporated by reference herein.

BACKGROUND

Air conditioning and industrial cooling systems typically make use of cooling towers to reject unwanted heat into the atmosphere. While cooling towers of various types may be utilized, wet (or evaporative) cooling towers are generally more efficient at heat removal, and accordingly are quite common in commercial and industrial applications. Such wet cooling towers generally cascade heated water over a "fill" material that provides for an enhanced water-to-air interface, allowing for increased evaporation and heat transfer. Cooled water is collected beneath the fill while heated, saturated air is expelled from the tower, usually via mechanical means such as a fan.

Even when water is filtered or treated, however, the fill material often becomes fouled with scaling and/or biological growth, both of which greatly diminish the ability of the cooling tower to efficiently expel heat. Proper cooling tower maintenance accordingly often includes a pre-rinse of the fill followed by application of chemical cleaners or inhibitors sprayed onto the fill material, and then a final rinse or wash of the fill to remove chemical residue along with dislodged and/or dissolved scale or biological materials. Such maintenance typically includes use of a specialized chemical sprayer to appropriately apply the chemical agents, followed by utilization of a high-pressure power-washing device to rinse and remove debris from the fill material.

BRIEF DESCRIPTION OF THE DRAWINGS

An understanding of embodiments described herein and many of the attendant advantages thereof may be readily obtained by reference to the following detailed description when considered with the accompanying drawings, wherein.

DETAILED DESCRIPTION

I. Introduction

Figure 1:
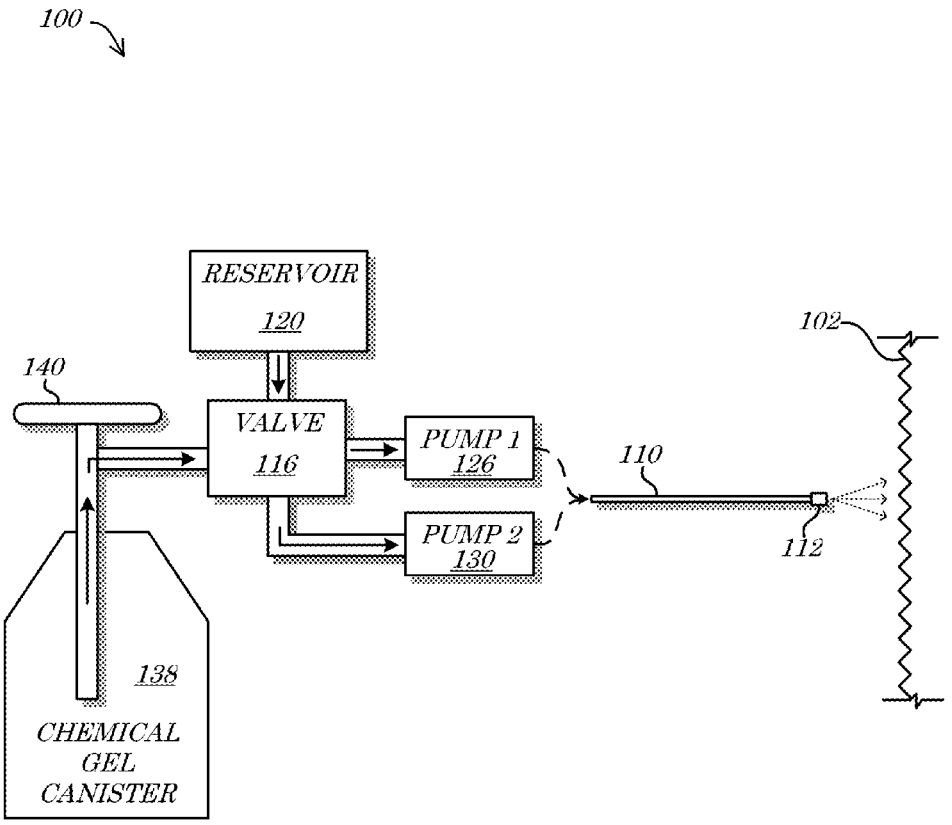
FIG. 1 is block diagram of a system according to some embodiments.

Embodiments described herein generally relate to chemical gel cleaning formulations for cooling tower fill (e.g., vertical surface) cleaning operations, and systems and methods for utilizing such chemical gel formulations to effectuate cooling tower fill (e.g., vertical surface) cleaning activities. While the term "gel" is utilized herein for ease of description, it should be understood that in one or more states and/or environments, the chemical cleaning/treatment formulations described herein may comprise liquids and/or gels as is or becomes desirable or practicable. The term "gel" is generally utilized herein to refer to a chemical cleaning/treatment formulation that is amenable to being sprayed onto a surface to be cleaned and exhibits certain changes in viscosity and/or effervesce upon application, as described in detail herein.

In some embodiments, chemical gel formulations may comprise a mixture of ingredients that combine to provide a viscosity that, when applied to, for example, a vertical surface (and/or a surface angled at greater than two degrees (2°) from the horizontal) and/or cooling tower fill in need of cleaning, tends to promote an optimal retention time of the formulation on the surface so that its active ingredients, in turn, can provide optimal cleaning performance. In one or more embodiments, the viscosity promoting optimal cleaning performance may be achieved when the chemical gel formulation comes into contact with, and is diluted by residual water on the vertical surface (e.g., residual water from a pre-rinse of the fill surface). For example, in some embodiments, the chemical gel formulation may have a thinner viscosity (e.g., ten to fifty centistokes (10-50 cSt)) before it is applied to a wet surface, and upon exposure to the wet environment and/or the undesirable deposits on the fill surface, the chemical gel formulation may thicken and become more viscous, for example between one hundred and three hundred centistokes (100-300 cSt)). Throughout this disclosure, water will be used as an example since it is a common residual solvent present on the surface of cooling tower fill (as a result of either or both of normal operations and a pre-rinse thereof). A person of ordinary skill will understand that water, as used herein, is an exemplary residual solvent. Chemical gel formulations can be made to perform similarly or identically with other organic or inorganic residual solvents present on (and/or applied to) a cooling tower fill and/or vertical surface to be cleaned.

Lower viscosity (e.g., approximately the same viscosity of water, or one centistoke (1 cSt)) chemical formulations, when applied to a surface in need of cleaning, have certain advantages over higher viscosity liquids and/or gels. For example, a lower viscosity liquid is easier to spray, and produces less backpressure that would otherwise result from spraying a higher viscosity liquid/gel. Moreover, a lower viscosity liquid may be sprayed in a more efficient manner, and may result in less waste and better cleaning performance. For example, a lower viscosity liquid may be sprayed further, and thus may permit easier access of cleaning to remote sections of cooling tower fill. This is especially advantageous when cleaning fill that includes various increased surface area features, for example, multiple bends, curves and other complex structures (e.g., honeycomb features) used to increase the surface area of the fill so that it is able to exchange heat effectively and efficiently.

A lower viscosity liquid may also be advantageous in that it may penetrate deeper into the undesired deposits residing on a surface in need of cleaning. For example, a less viscous formulation may be less likely to reside on the surface of deposits, and more likely to sink into and penetrate microscopic accretion and pitting created by the accumulation of undesired deposits, such as calcium carbonate. This allows deposits to be removed from the surface in need of cleaning with greater efficacy and efficiency, as the descaling process is allowed to proceed at the top layer of the surface and thus the base of the deposits.

On the other hand, a lower viscosity chemical formulation when applied to a given surface has certain disadvantages. For example, low viscosity liquids may not have optimal retention time, for example, on vertical surfaces (e.g., vertical fill surfaces and/or portions of cooling tower fill surfaces that are oriented at an angle to the horizontal—e.g., to promote cooling water flow and/or cascading). For example, a low viscosity liquid (and/or gel) may easily become separated from and fall off of a vertical/angled surface due to the pull of gravity. Due to such decreased dwell or "hang" time on a vertical/angle surface, lower viscosity formulations must typically include higher concentrations of acid to allow for desired effectiveness of scale and/or biofilm removal. Higher concentration acids, however, increase occupational hazards in application, particularly in the case that they are sprayed in a pressurized, low viscosity liquid formulation. Low viscosity liquid formulations are subject to misting, for example, which can result in a high concentration acid mist that may have high mobility from and around an application site. As many cooling towers are on top of buildings and/or in highly-populated areas (e.g., city rooftops), acid misting is not a desirable occurrence.

Higher viscosity liquids or gels may not suffer the same issues because increased viscosity may have the effect of increasing retention times of the chemical gel formulation on the vertical/angled surface, and may eliminate the potential for misting. Thus, higher viscosity liquids/gels will allow the reactive ingredients present within a cleaning formulation to remain on the vertical/angled surface for longer periods of time, thereby optimizing the chemical gel's cleaning performance even at lower acid concentrations. Moreover, the increased retention time of higher viscosity formulations minimize the need to apply several coats of a cleaning formulation, as a single coat may be all that is necessary to perform the task of removing undesirable deposits. In practice, however, thicker formulations also experience deficiencies. Higher viscosity liquids/gels generally impede transport of dissolved scale and/or other deposits, for example, and tend to leave a residue on vertical/angled surfaces such as cooling tower fill—the residue being undesirable, as it gives the appearance of an incomplete cleaning application (and may even impede cooling tower performance). Further, higher viscosity formulations tend to encapsulate and/or inhibit reaction of the active ingredients with deposits on the vertical/angled surface to be cleaned. A portion of the high viscosity formulation will react with the surface and, in the case of an acid reacting with a calcium carbonate scale deposit for example, will off-gas carbon dioxide. The carbon dioxide will create bubbles adjacent to the surface and in the case of a high viscosity liquid/gel, the viscosity of the formulation may prevent the carbon dioxide from transporting through the formulation, impeding additional active ingredients from reacting with the surface—as the gaseous bubbles form a barrier preventing physical contact of the active ingredients with the deposits on the surface.

While foam formulations have been attempted in an effort to move away from the problems experienced by each of the low viscosity liquids and the high viscosity liquid/gel formulations, such formulations have also experienced limited success due to operations difficulties. Foam formulations necessarily have lower acid concentrations, for example, and accordingly are less effective at removing scale deposits. While their increased dwell time offsets this inefficiency somewhat, as foam is light and presents high surface area by nature, it is highly susceptible to being transported by breezes and/or during rinse-off or power washing processes.

Accordingly, several novel embodiments of the chemical gel formulations described herein combine various advantageous properties of both lower viscosity and higher viscosity formulations. For example, as disclosed herein, a lower viscosity gel formulation may thicken to a higher viscosity formulation upon contact with a surface in need of cleaning and accordingly may exhibit multiple cleaning advantages over formulations that have either lower or higher viscosity, such as in the case that a surface is exposed to outdoor conditions (e.g., exterior walls of a surface in need of cleaning that may be exposed to outdoor elements). In one or more embodiments of the chemical gel formulations described herein, one or more desirable characteristics of the lower viscosity liquids (e.g., for increased spraying and penetration) may be combined with one or more desirable characteristics of a higher viscosity liquid/gel (e.g., increased retention time and cleaning potential). Further, in some embodiments, the novel chemical gel formulations described herein may reduce or eliminate the reactive encapsulation effect of higher viscosity formulations, providing for a more efficient and effective cleaning solution.

Creating a chemical gel formulation that thickens upon contact with a surface for cleaning can be achieved in many ways, and the following examples are not provided to limit the scope of the embodiments herein, but rather to provide examples of how such formulations may be created. The method or process of creating a formulation that thickens upon contact with a given surface can be achieved in a variety of ways. For example, in some embodiments, the viscosity of a chemical gel formulation may be increased upon its application to a surface in part by the evolution of gas created by the active ingredients reacting with the undesirable deposits; for example, certain acidic active ingredients may react with calcium carbonate deposits on a surface for cleaning, and the off-gas may be combined with the gel carrier of the formulation to create a foaming effect. Thus, in accordance with one or more embodiments, a chemical gel formulation may be formulated in a manner that it becomes more viscous as it is permeated by effervescence from the reaction of the active ingredients with undesirable deposits on the surface in need of cleaning, thereby creating a higher viscosity foam with optimal retention times, for example, on vertical and/or angled surfaces.

Examples of acidic active ingredients that may be used in chemical gel formulation disclosed herein include citric acid, hydrochloric acid, sulfuric acid, sulfurous acid, phosphoric acid, phosphorous acid, nitric acid, nitrous acid, hydrobromic acid, bromous acid, hydroiodic acid, perchloric acid, chloric acid, boric acid, acetic acid, formic acid, oxalic acid, pyruvic acid, malonic acid, malic acid, tartaric acid, propanoic acid, lactic acid, succinic acid, and carbonic acid. According to some embodiments, the chemical gel formulation may comprise a combination of phosphoric acid, hydrochloric acid, and citric acid present in a percent weight of the final formulation.

It has been found that chemical gel formulations comprising certain combinations and amounts of acids have provided surprising, unexpected and advantageous results over other formulations. For example, it has been found that the combination of citric, phosphoric and hydrochloric acids may provide optimal cleaning performance when compared to other acid combinations. Specifically, it has been found that a formulation may comprise a combination of citric, phosphoric and hydrochloric acids at a ratio of 11:9:3.5 to provide superior cleaning properties, however the phosphoric acid and citric acids may be added in a range of about 5-40% by weight of the final formulation, and hydrochloric acid may be added in a range of about 1-36% by weight of the final formulation. The combination of these acids also provides a surprising advantage over other cleaning formulations by creating a protective sheen or glaze on the cleaned surface, thus helping to protect the cleaned surface from the accrual of future deposits, thereby significantly increasing the cleaning performance of the chemical gel formulation.

In other embodiments, chemical gel formulations that thicken upon application to a surface for cleaning may comprise ingredients that react with water, and thus effervesce in the presence of residual water residing on the surface. Examples of ingredients that may react with water to effervesce including alkali metals, alkaline earth metals, carbides, hydrides and anhydrides. For example, in some embodiments, sodium hydride or butyllithium may be utilized as ingredients that react with water and effervesce to increase the viscosity of the chemical gel formulation upon application to a wet surface.

Chemical gel formulations that increase in viscosity upon application to a surface may also or alternatively be made through other means, for example, through the addition of water insoluble ingredients that precipitate and thicken upon contact with water. For example, hydrophobic compounds such as oils, parabens, waxes, or other water insoluble organic or inorganic compounds may be used to precipitate and thicken upon application to a wet surface, thus increasing the viscosity of a chemical gel formulation. In other embodiments, one or more ingredients that react with each other in an aqueous environment may be added to a chemical gel formulation to increase its viscosity when applied to a surface for cleaning. In still other embodiments, the viscosity of the chemical gel formulation may be increased by adding a water-absorbent ingredient, for example polymers, that swell creating a more viscous formulation upon contact with residual water on a surface in need of cleaning.

A chemical gel formulation, in accordance with multiple embodiments disclosed herein, may be formed of ingredients that may be altered to achieve a desired viscosity both pre and post application to a surface in need of cleaning. According to some embodiments, the individual ingredients comprising the chemical gel formulation may be solid, semi-solid or liquid at ambient temperature, so long as the combination of these ingredients achieve a desired viscosity when applied to a surface for cleaning. For example, in one or more embodiments, glycerin, which may be used as a carrier for the chemical gel formulation, may be thickened to a desired viscosity using one or more polysaccharides. Polysaccharides that may be used for thickening the glycerin carrier may include, without limitation, starch, glycogen, cellulose, chitin, or any combination of these or other polysaccharides.

One or more embodiments of chemical gel formulations disclosed herein may comprise one or more corrosion inhibitors. A corrosion inhibitor is a chemical ingredient that may be applied to a surface to decrease the corrosion rate of that material. The materials typically treated with corrosion inhibitors are metals and alloys, but other types of materials may also or alternatively be treated. Corrosive inhibitors that may be used in chemical gel formulations include, for example, free radical scavengers, antioxidants, anodic inhibitors, cathodic inhibitors, tolytriazole, sodium molybdate, or any combination thereof.

Several embodiments of chemical gel formulations discussed herein may comprise one or more surfactants. Surfactants used as ingredients in chemical gel formulations disclosed herein include, without limitation, organic surfactants, inorganic surfactants, ionic surfactants, non-ionic surfactants, cationic surfactants, anionic surfactants, amphoteric surfactants, polymeric surfactants, or any combination of these or other known surfactants.

Some embodiments of chemical gel formulations described herein may comprise one or more biofilm disruptors. A biofilm is residue consisting of organic and inorganic elements and compounds that naturally occur on surfaces that are exposed to moisture-laden environments. For example, biofilm may comprise a layer of slime resultant from bacterial growth and waste products. Sometimes biofilms may further comprise a layer of inorganic salts and minerals deposited, for example, by hard water. Biofilm disruptors may be used to effectively dissolve these organic and inorganic residues. Many different types of biofilm disruptors are known in the art, and may be used in chemical gel formulations in accordance with embodiments described herein. For example, biofilm disruptors that may be utilized include (but are not limited to) acids, bases, surfactants, polymers, film-forming ingredients, oxidizing agents, phosphate-containing ingredients, chlorine-containing ingredients, carbonates, and alkylalkoxylates.

Referring now to FIG. 1, a block diagram of a cleaning system 100 for utilizing chemical gel formulations according to some embodiments is shown. In some embodiments, the system 100 may comprise a surface 102, which may comprise a vertical, angled, and/or textured surface (as depicted), such as a cooling tower fill surface as described herein. In some embodiments, the system 100 may comprise a cleaning wand 110 coupled to deliver fluid flow to a spray nozzle 112. The spray nozzle 112 (and/or the cleaning wand 110) may be utilized, for example, to direct water, a cleaning formulation (e.g., a cleaning gel as described herein), compressed air/gas, sound waves, and/or a combination thereof to the surface 102 (e.g., to effectuate cleaning and/or agitation thereof). According to some embodiments, various fluids may be directed to the cleaning wand 110 via a valve 116. The valve 116 may be coupled, for example, to a reservoir 120 via which water (or another aqueous rinse or wash fluid; not explicitly shown) may be directed through the cleaning wand 110 and the spray nozzle 112, to the surface 102. In some embodiments, the flow of the fluid from the reservoir 120 may be pressurized, such as utilizing a first pump 126. In some embodiments, the first pump 126 may comprise a high-pressure and/or high-flow pump coupled to draw the rinse/wash fluid from the reservoir 120 (e.g., a water supply source such as a spigot, which itself may be pressurized in some embodiments) and provide a pressurized flow of the fluid through the cleaning wand 110 and the spray nozzle 112, to the surface 102.

According to some embodiments, the valve 116 may also or alternatively be coupled to a second pump 130. In some embodiments, the second pump 130 may comprise a low-flow and/or low-pressure pump coupled to draw and/or direct a cleaning agent and/or formulation (not explicitly shown) from a chemical gel canister 138. According to some embodiments, the chemical formulation may be drawn through a chemical flow valve assembly 140 and directed the chemical formulation through the cleaning wand 110 and the spray nozzle 112, to the surface 102. In some embodiments, the valve 116 may be selectively operable to switch between chemical formulation flow and wash fluid flow, and/or may be selectively operable to vary a ratio of chemical formulation and wash fluid in a combined flow stream. According to some embodiments, the cleaning wand 110 may be selectively coupled to accept either or both of the chemical formulation flow and the wash fluid flow.

In some embodiments, the system 100 be similar to the portable, dual-pump cooling tower cleaning apparatus described in co-pending and co-owned U.S. patent application Ser. No. 14/737,995 filed on Jun. 12, 2015 and titled "PORTABLE COOLING TOWER CLEANING SYSTEM", the dual-pump system components, concepts, and descriptions of which are hereby incorporated by reference herein. According to some embodiments, the chemical flow valve assembly 140 may be specially configured as also described in co-owned U.S. patent application Ser. No. 14/737,995 filed on Jun. 12, 2015 and titled "PORTABLE COOLING TOWER CLEANING SYSTEM", the chemical flow valve assembly components, concepts, and descriptions of which are also hereby incorporated by reference herein. In some embodiments, the system 100 may be utilized to perform various cleaning functions and/or procedures such as may be desirable to effectuate cleaning of cooling tower components such as cooling tower fill disposed as a vertical/angled surface. The system 100 may, for example, be utilized to direct a novel chemical gel formulation (as described herein) from the chemical gel canister 138 and onto the surface 102, and/or to perform such directing in coordination with various rinse and/or wash activities.

Figure 2:
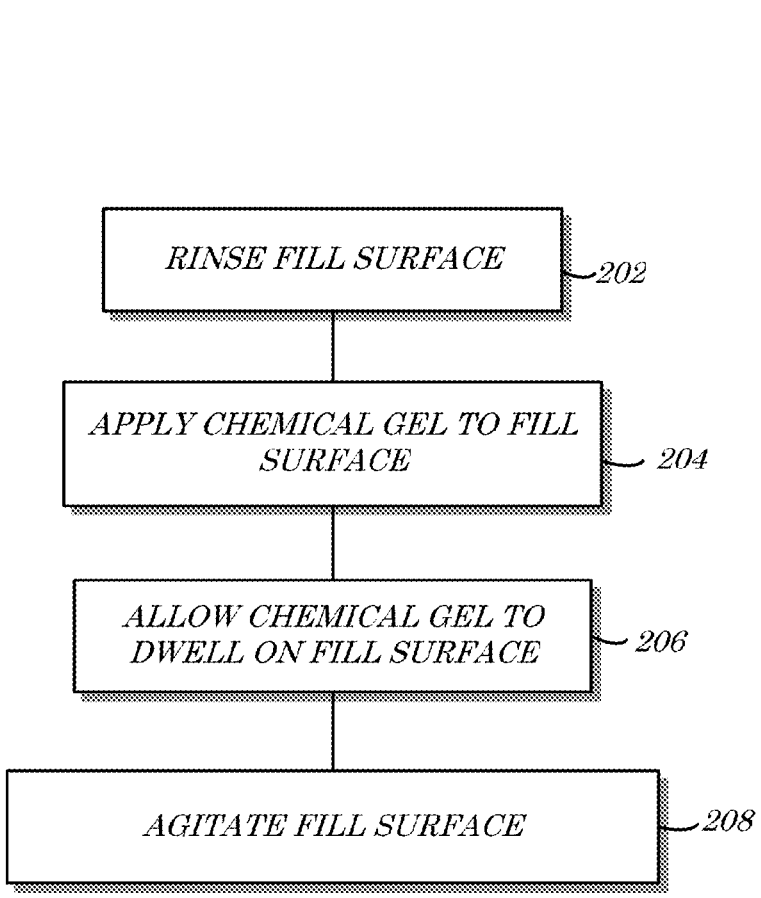
FIG. 2 is a flow diagram of a method according to some embodiments.

Referring to FIG. 2 for example, a flow diagram of a method 200 according to some embodiments is shown. The method 200 may, in some embodiments, comprise a method of utilizing a chemical gel formulation to clean a vertical cooling tower fill surface (e.g., the surface 102 of FIG. 1). The process diagrams and flow diagrams described herein do not necessarily imply a fixed order to any depicted actions, steps, and/or procedures, and embodiments may generally be performed in any order that is practicable unless otherwise and specifically noted. While the order of actions, steps, and/or procedures described herein is generally not fixed, in some embodiments, actions, steps, and/or procedures may be specifically performed in the order listed, depicted, and/or described and/or may be performed in response to any previously listed, depicted, and/or described action, step, and/or procedure.

The method 200 may, in some embodiments, comprise rinsing the fill surface with an aqueous solution, or other acceptable rinse/wash solution, at 202. Cooling tower fill material may be wetted, for example, as a pre-rinse procedure such as to remove any easily dislodged deposits on the surface. According to some embodiments, the pre-rinse may be effectuated with either a low-flow, low-pressure pump or a high-flow, high-pressure pump of a portable cooling tower cleaning apparatus. The pre-rinse may, for example, comprise pressurized water being directed from the reservoir 120, via the valve 116, and through the cleaning wand 110 and the spray nozzle 112 and onto the surface 102, by the first pump 126, all of FIG. 1 herein.

In some embodiments, the method 200 may comprise applying a chemical gel formulation to the fill surface, at 204. The chemical gel formulation may, for example, comprise an initially low viscosity gel (e.g., approximately ten centistokes (10 cSt)) that is sprayed onto the surface. In some embodiments, as described herein the chemical gel formulation may comprise a mixture of three acids entrained in a water-soluble transport mechanism (e.g., glycerol). The acid mixture may be released to interface with deposits on the fill surface as the glycol is dissolved by residual water/rinse agent on the surface. In some embodiments, the chemical gel formulation may generate a thickened froth or localized foam that increases the overall viscosity of the applied formulation as the acid mixture interfaces with and produces off-gassing from the deposits on the surface. In some embodiments, the application of the chemical gel formulation may comprise the chemical gel formulation being drawn from a chemical canister 138 and directed, via the valve 116, through the cleaning wand 110 and the spray nozzle 112 and onto the surface 102, by the second pump 130, all of FIG. 1 herein. In some embodiments, the chemical gel formulation may be drawn from the chemical canister or other container via the specially-designed chemical flow valve assembly 140 of FIG. 1.

According to some embodiments, the method 200 may comprise allowing the chemical gel formulation to dwell on the fill surface, at 206. The chemical gel may be allowed to reside on the surface of the fill being cleaned for a predetermined amount of time. The predetermined amount of time may vary on the specific application for which the chemical gel formulation is being used. For example, in some applications, it may be advantageous to allow the gel to reside on the surface for cleaning for several minutes, while in other applications, it may be desirable to let the gel reside on the surface for several hours. In cooling tower cleaning operations with typical operational fouling, the chemical gel formulation may be left to act upon the surface for a minimum dwell time of one (1) hour.

In some embodiments, the method 200 may comprise agitating the fill surface, at 208. According to some embodiments, the agitating may comprise a rinsing of the fill surface, such as to remove any residual cleaning formulation and/or dissolved deposits. In some embodiments, the agitating may comprise a mechanical, hydraulic, sonic, and/or other agitation of the treated surface. The agitation may, for example, comprise pressurized water being directed from the reservoir 120, via the valve 116, and through the cleaning wand 110 and the spray nozzle 112 and onto the surface 102, by the first pump 126, all of FIG. 1 herein. In some embodiments, the spray nozzle 112 may comprise a "turbo" or oscillating nozzle head that utilizes variations in water pressure, flow pulsing, and/or flow direction to apply agitation forces to the surface being rinsed/washed. In some embodiments, the agitation may comprise application of sonic waves toward the fill surface, e.g., via a speaker (not shown). According to some embodiments, the agitation may comprise imparting vibration directly to the fill surface, such as by utilizing a mechanical and/or electro-mechanical vibration device coupled to the fill (also not shown). In some embodiments, the agitation may be effectuated by the reaction of the chemical formulation with the fill surface deposits and/or surface-borne water. As described herein, for example, the effervescence of the applied chemical formulation may result from the interface of the chemical formulation with off-gas from the treated deposits and/or may result from an interface of the glycol transport medium with an aqueous environment of the surface. Such effervescence may not only promote acid mobility and/or minimize or prevent reaction encapsulation, but may also impart mechanical agitation forces to the fill surface.

In some embodiments, an agitated pressure rinse/wash of the treated surface removes residual chemical gel formulation components and dislodged and/or dissolved deposits from the fill surface. In some embodiments, after rinsing, the fill may be imparted with a sheen or shine as a result of the action of the acid mixture (or a portion thereof, such as citric acid in the case that it is utilized) on the fill surface. Fill surfaces are often constructed from Poly-Vinyl Chloride (PVC) synthetic plastic polymer and formed in honeycomb sheets, which are often black in color. In some embodiments, the novel chemical gel formulation(s) disclosed herein may act upon and darken the fill surface leaving the surface shiny and black, which provides an expedient indicator of a properly cleaned surface (e.g., as opposed to a black surface with residual residue white residue from utilization of higher viscosity gel cleaners).

According to some embodiments, the method 200 may optionally comprise neutralizing the chemical gel formulation. In some applications, for example, such as in the case that the reaction of the formulation with the surface and/or deposits thereof is desired to be ended, a neutralizing agent may be applied (e.g., a base). In some embodiments, the neutralizing may be conducted in place of the rinsing. In such a manner, for example, water usage may be decreased for the overall cleaning operation. According to some embodiments, the neutralizing may be accomplished in addition to or as part of the rinsing at 208. The rinse/wash fluid may comprise an aqueous mixture or solution comprising a neutralizing agent and water, for example, sprayed on the fill surface to both dislodge or remove and neutralize any residual chemical gel formulation on the fill surface.

In some embodiments, a chemical gel cleaning formulation for cleaning vertical/angled fill surfaces of cooling towers may comprise: (i) glycerine; (ii) at least one polysaccharide; (iii) at least one corrosion inhibitor; (iv) at least one surfactant; and/or (v) at least one acid. According to some embodiments, the chemical gel has a first viscosity, and when applied to a surface in need of cleaning, the chemical gel achieves a second viscosity greater than the first viscosity. In some embodiments, the at least one corrosion inhibitor may comprise tolytriazole. In some embodiments, the at least one corrosion inhibitor may comprise sodium molybdate. In some embodiments, the at least one corrosion inhibitor may comprise tolytriazole and sodium molybdate. In some embodiments, the at least one surfactant may comprise an ionic surfactant. In some embodiments, the at least one surfactant may comprise a non-ionic surfactant. In some embodiments, the at least one surfactant may comprise an anionic surfactant. In some embodiments, the at least one surfactant may comprise a cationic surfactant. In some embodiments, the at least one surfactant may comprise an amphoteric surfactant. In some embodiments, the at least one surfactant may comprise a polymeric surfactant. In some embodiments, the first viscosity of the chemical gel at ambient temperature may be about 10 to 50 centistokes. In some embodiments, the first viscosity of the chemical gel at ambient temperature may be about 25 to 45 centistokes. In some embodiments, the first viscosity of the chemical gel at ambient temperature may be about 30 to 40 centistokes. In some embodiments, the first viscosity of the chemical gel at ambient temperature may be about 35 centistokes. In some embodiments, the chemical gel cleaning formulation may further comprise at least one biofilm disrupter. In some embodiments, the at least one biofilm disrupter may comprise an acid. In some embodiments, the at least one biofilm disrupter may comprise a base. In some embodiments, the at least one biofilm disrupter may comprise a surfactant. In some embodiments, the at least one biofilm disrupter may comprise an organic surfactant. In some embodiments, the at least one biofilm disrupter may comprise an inorganic surfactant. In some embodiments, the at least one biofilm disrupter may comprise a polymer. In some embodiments, the at least one biofilm disrupter may comprise a film-forming ingredient. In some embodiments, the at least one biofilm disrupter may comprise an oxidizing agent. In some embodiments, the at least one biofilm disrupter may comprise a phosphate-containing ingredient. In some embodiments, the at least one biofilm disrupter may comprise a chlorine-containing ingredient.

According to some embodiments, a process of using a chemical gel cleaning formulation to clean a vertical/angled surface of a cooling tower fill may comprise: (i) applying a pre-rinse fluid to the vertical surface; (ii) applying the chemical gel cleaning formulation onto the vertical surface, the chemical gel cleaning formulation comprising glycerin, at least one polysaccharide, at least one corrosion inhibitor, at least one surfactant, and at least one acid; (iii) allowing the chemical gel cleaning formulation to dwell on the vertical surface for at least one hour; and (iv) rinsing the vertical/angled surface to remove residual chemical gel cleaning formulation and dissolved deposits from the vertical surface. In some embodiments, the rinsing may comprise applying a rinse fluid to the vertical/angled surface via an oscillating spray nozzle. In some embodiments, the process may further comprise agitating the vertical/angled surface. In some embodiments, the agitating may comprise at least one of pneumatic, hydraulic, mechanical, and sonic agitation. In some embodiments, the process may further comprise neutralizing, after the allowing, the residual chemical gel cleaning formulation. In some embodiments, the pre-rinse fluid and the rinse fluid may comprise an aqueous solution comprising one or more of: (i) water; (ii) water and inorganic solutes; and (iii) water and organic solutes. In some embodiments, the applying of the pre-rinse fluid may be accomplished by utilizing a first pump of a portable cooling tower cleaning apparatus and wherein the applying of the chemical gel cleaning formulation is accomplished by utilizing a second pump of the portable cooling tower cleaning apparatus. In some embodiments, the first pump operates at a higher pressure and a higher flow rate than the second pump.

The present disclosure provides, to one of ordinary skill in the art, an enabling description of several embodiments and/or inventions. Some of these embodiments and/or inventions may not be claimed in the present application, but may nevertheless be claimed in one or more continuing applications that claim the benefit of priority of the present application. Applicants intend to file additional applications to pursue patents for subject matter that has been disclosed and enabled but not claimed in the present application.

What is claimed is:

1. A chemical gel cleaning formulation for cleaning vertical fill surfaces of cooling towers, comprising:

glycerine;

at least one polysaccharide;

at least one corrosion inhibitor;

at least one surfactant; and each of citric acid, phosphoric acid, and hydrochloric acid;

wherein the chemical gel has a first viscosity, and when applied to a surface in need of cleaning, the chemical gel achieves a second viscosity greater than the first viscosity.

2. The chemical gel cleaning formulation of claim 1, wherein the citric acid is present in a range of about 5-40% by weight of the chemical gel.

3. The chemical gel cleaning formulation of claim 1, wherein the phosphoric acid is present in a range of about 5-40% by weight of the chemical gel.

4. The chemical gel cleaning formulation of claim 1, wherein the hydrochloric acid is present in a range of about 1-36% by weight of the chemical gel.

5. The chemical gel cleaning formulation of claim 1, wherein the citric acid, phosphoric acid and hydrochloric acid are present at a respective ratio of 11:9:3.5.

6. The chemical gel cleaning formulation of claim 1, wherein the at least one polysaccharide comprises a starch.

7. The chemical gel cleaning formulation of claim 1, wherein the at least one polysaccharide comprises glycogen.

8. The chemical gel cleaning formulation of claim 1, wherein the at least one polysaccharide comprises cellulose.

9. The chemical gel cleaning formulation of claim 1, wherein the at least one polysaccharide comprises chitin.

10. The chemical gel cleaning formulation of claim 1, wherein the at least one corrosion inhibitor comprises a free radical scavenger.

11. The chemical gel cleaning formulation of claim 1, wherein the at least one corrosion inhibitor comprises an antioxidant.

12. The chemical gel cleaning formulation of claim 1, wherein the at least one corrosion inhibitor comprises an anodic inhibitor.

13. The chemical gel cleaning formulation of claim 1, wherein the at least one corrosion inhibitor comprises a cathodic inhibitor.

14. The chemical gel cleaning formulation of claim 1, wherein the at least one corrosion inhibitor comprises a mixture of an anodic inhibitor and a cathodic inhibitor.

* * * * *